US009739456B2

(12) United States Patent
Rauer-Hans

(10) Patent No.: US 9,739,456 B2
(45) Date of Patent: Aug. 22, 2017

(54) LUMINAIRE HAVING A CLAMPING MEMBER

(71) Applicant: Bega Gantenbrink-Leuchten KG, Menden (DE)

(72) Inventor: Sabine Rauer-Hans, Menden (DE)

(73) Assignee: BEGA GANTENBRINK-LEUCHTEN KG, Menden (DE)

( * ) Notice: Subject to any disclaimer, the term of this patent is extended or adjusted under 35 U.S.C. 154(b) by 280 days.

(21) Appl. No.: 14/525,908

(22) Filed: Oct. 28, 2014

(65) Prior Publication Data

US 2015/0146438 A1 May 28, 2015

(30) Foreign Application Priority Data

Nov. 25, 2013 (EP) ..... 13005488

(51) Int. Cl.

| | |
|---|---|
| ***F21S 8/00*** | (2006.01) |
| ***F21V 17/10*** | (2006.01) |
| ***F21V 31/00*** | (2006.01) |
| ***F21V 15/01*** | (2006.01) |
| ***F21V 17/12*** | (2006.01) |
| ***F21V 17/16*** | (2006.01) |

(52) U.S. Cl.

CPC ..... *F21V 17/107* (2013.01); *F21V 15/01* (2013.01); *F21V 17/104* (2013.01); *F21V 17/12* (2013.01); *F21V 17/164* (2013.01); *F21V 31/005* (2013.01)

(58) Field of Classification Search

CPC ..... F21V 17/107

USPC ..... 362/147, 432, 374–375

See application file for complete search history.

(56) References Cited

U.S. PATENT DOCUMENTS

| | | | | |
|---|---|---|---|---|
| 7,249,870 | B1 * | 7/2007 | Shwisha | F21S 8/033 362/147 |
| 2002/0167813 | A1 * | 11/2002 | Wang | F21V 17/164 362/374 |
| 2013/0121759 | A1 | 5/2013 | Breidenassel et al. | |

FOREIGN PATENT DOCUMENTS

| | | | |
|---|---|---|---|
| BE | 750444 | A1 | 10/1970 |
| DE | 20321366 | U1 | 12/2006 |
| EP | 0148334 | A2 | 7/1985 |
| EP | 0539621 | A1 | 5/1993 |
| FR | 2638508 | A1 | 5/1990 |
| WO | 2012007413 | A1 | 1/2012 |
| WO | 2012139311 | A1 | 10/2012 |

* cited by examiner

*Primary Examiner* — Sean Gramling
(74) *Attorney, Agent, or Firm* — Baker and Hostetler LLP

(57) ABSTRACT

A luminaire comprises a first housing element which includes at least one groove, a second housing element, and a clamping member. The clamping member of a generic luminaire further comprises a first connection area and a second connection area, the first connection area interacting with the groove and the second connection area being connected, in the assembled state, to the second housing element so that the second housing element is clamped by the clamping member relative to the first housing element. The clamping member is pivotably mounted in the groove, in a plane perpendicular to the longitudinal extension of the groove.

15 Claims, 8 Drawing Sheets

LUMINAIRE HAVING A CLAMPING MEMBER

CROSS-REFERENCE TO RELATED APPLICATION

This application claims priority to foreign European patent application No. EP 13005488.5, filed on Nov. 25, 2013, the disclosure of which is incorporated by reference in its entirety.

FIELD OF THE INVENTION

The present invention relates to a luminaire according to the preamble of independent claim 1. A generic luminaire comprises a first housing element which includes at least one groove, a second housing element, and a clamping member. The clamping member of a generic luminaire further comprises a first connection area and a second connection area, the first connection area interacting with the groove and the second connection area being connected, in the assembled state, to the second housing element so that the second housing element is clamped by the clamping member relative to the first housing element.

BACKGROUND

It is known from the prior art to use seals so as to protect the components of the luminaire from humidity or dirt.

A luminaire of the above-mentioned type is known from EP 0 539 621 B1. In this luminaire, a clamping member is used to clamp a supporting plate relative to a side part. To this end, the clamping member configured as an angular rail part is inserted, with one end, into a rectangular groove on the side part and screwed to the supporting plate.

The disadvantage of the luminaire known from EP 0 539 621 B1 is that the clamping member is unable to clamp the side part relative to the supporting plate in a reliable manner. Tolerances ensuing from the production cause the clamping member to tilt in the groove so that the groove and the clamping member may get easily damaged, and the supporting plate and the side part are not reliably clamped relative to one another. This can be compensated by a plurality of clamping members, which unnecessarily renders the assembly more complicated.

SUMMARY OF THE INVENTION

It is the object of the present invention to provide a luminaire of the above-mentioned type, of which the two housing elements can be clamped relative to one another in a reliable manner and which is easy to assemble. If a seal is arranged between the first housing element and the second housing element a reliable sealing of the luminaire is desired.

The object is achieved by the features of claim 1. Accordingly, in connection with a luminaire of the above-mentioned type, the object is solved in accordance with the invention if the clamping member is pivotably mounted in the groove, in a plane perpendicular to the longitudinal extension of the groove. In accordance with the invention pivotably mounted not only implies a pure rotation of the clamping member, but it also includes an additionally or simultaneously occurring translation of the clamping member.

The first housing element may be a housing frame or a part of a housing frame, but also a supporting plate or a mounting plate as well as a simple mounting element. The second housing element may be a lid-type component part, but also a supporting plate or a mounting plate, a fixing element or another component of the luminaire relative to which the first housing element is to be clamped.

In accordance with the invention it is possible that at least one further component of the luminaire is arranged between the first housing element and the second housing element. This component can be, for instance, a cover glass.

In accordance with the invention the groove may be arranged on an optional surface of the first housing element. Moreover, the first housing element may comprise several differently configured grooves which are arranged on the same or different surfaces.

The invention has the advantages that the first housing element and the second housing element can be clamped relative to one another in a reliable manner. The clamping member may furthermore be configured to rest against the second housing element, between the groove and the connection to the second housing element, so that the force transferred to the clamping member is transferred more intensively to the second housing element by a leverage. A luminaire according to the invention can be designed in a very modular manner. For instance, if several grooves are used on the first housing element, it is possible to mount various second housing elements in the luminaire.

Preferably, at least one interlocking member is formed in the first connection area, the groove and the interlocking member being configured such that the interlocking member can be pivoted in the groove.

Advantageous embodiments of the present invention are defined in the dependent claims.

In a preferred embodiment the clamping member is configured to be rigid so that the clamping effect is realized by the connection of the second connection area with the second housing element. The clamping member is preferably made of metal in the form of a cast part, or from a profile.

In a preferred embodiment the clamping member is captively held in the groove in at least one pivoted position. Thus, the assembly is significantly simplified as the clamping member need not be held fast during the assembly. It is also conceivable to configure the first connection area and the groove such that the clamping member is captively held in the groove in all pivoted positions.

In another preferred embodiment the clamping member, pivoting in the groove, can be transferred from an assembling position into the position in the assembled state. Thus, the assembly of the luminaire is simplified. Advantageously, the clamping member is captively held in the assembling position. This allows that the clamping member is first placed in the assembling position and, thereupon, the second housing element can be inserted into the luminaire.

In a particularly preferred embodiment the angle of rotation between the position in the assembled state and the assembling position is at least 60°. Thus, a large clearance is obtained in the assembling position allowing to mount yet other components of the luminaire. Preferably, the angle of rotation is at least 80°.

In another preferred embodiment the first housing element surrounds the second housing element in a frame-like manner and comprises, on at least two opposite inner sides, a groove. The grooves each interact with at least one clamping member, the clear distance of two opposite clamping members being, in the assembling position, at least as large as the expansion of the second housing element. This means that the clamping members allow a straight insertion of the second housing element in the assembling position. This simplifies an assembly of the luminaire by a machine. In this embodiment a one-part or a multi-part first housing element surrounds, at least section-wise, the second housing element. For instance, the first housing element may be designed as a surrounding frame into which a second housing element designed as a lid is inserted.

In another preferred embodiment the clamping member can be displaced in the groove, along the longitudinal extension of the groove. As the position of the clamping member can be adapted to different second housing elements along the groove the luminaire according to the invention can be applied in a more versatile manner.

In another preferred embodiment the groove is discontinued by at least one insertion portion, the clamping member being insertable into the groove, through the insertion portion, in the direction of the longitudinal extension of the groove. An insertion portion of this type allows an easy insertion of the clamping member into the groove. Preferably, at least one part of the wall of the groove in the insertion portion can be discontinued so that the clamping member can be inserted into the insertion portion in a direction parallel to the surface of the first housing element. It is also conceivable, however, to modify the shape of the groove in the insertion portion to allow the insertion of the clamping member into the insertion portion in a direction perpendicular to the surface of the first housing element. For instance, the groove may be widened in the insertion portion.

Alternatively, it is also conceivable to configure the groove and the first connection area such that the clamping member can be transferred into a pivoted position in which it can be removed from the groove, respectively, inserted into the groove in the opposite direction by a pivoting movement in a plane perpendicular to the longitudinal extension of the groove.

In another preferred embodiment the groove and the clamping member interact in the manner of a hinge joint. This embodiment represents a type of the pivotable mounting according to the invention that is particularly easy to produce.

In another preferred embodiment the groove comprises a first undercut which encompasses one end of the first connection area. Thus, a large contact surface between the groove and the first connection area is obtained, and the clamping member is prevented from falling out in a direction perpendicular to the end of the first connection area. The extent of the encompassment allows a limitation of the range of the angle of rotation of the clamping member. A suitable configuration of the first undercut makes it easily possible that the clamping member is captively held in the groove.

In a particularly preferred embodiment the groove comprises a second undercut, the second undercut overlapping the first connection area. For instance, the second undercut can surround a portion of the first connection element in a tub-like manner. Thus, the clamping member is prevented from falling out in a direction perpendicular to the second undercut.

In another preferred embodiment the first connection area is formed substantially hook-shaped. The bent off end interacts with the first undercut, and the adjoining bent section engages with the second undercut. A hook-shaped clamping member can be easily produced from a profile or in the form of a cast part.

In another preferred embodiment the second connection area is screwed to the second housing element. This type of detachable connection allows an easy assembly and disassembly of the luminaire. It is possible, for instance, to screw screws through the clamping member into threaded bores which are formed on the second housing element. Alternatively, it is conceivable that threaded bolts are formed on the second housing element, which penetrate the clamping member and on which nuts are screwed for fastening them. Alternatively, other detachable connecting methods are conceivable as well, however.

In another preferred embodiment at least one slot is formed in the second connection area which, in the assembled state, extends perpendicular to the longitudinal extension of the groove. Thus, the clamping member can even be pivoted if it is penetrated by a fixing element, such as a threaded bolt formed on the second housing element. This allows, for instance, the use of a nut so as to transfer the clamping member into the assembled state when fastening the nut, whereby the threaded bolt moves as a result of the pivoting movement of the clamping member in the slot.

In another preferred embodiment the edges of the second housing element are rounded, at least in the region of the clamping members. Rounded edges increase the contact surface to the clamping member, and prevent damage to a clamping member resting against the second housing element by a punctiform load.

In another preferred embodiment the clamping member comprises a contact area which is arranged between the first connection area and the second connection area, the contact area being in contact with an edge of the second housing element at least in the assembled state. In the second connection area, on the side facing away from the second housing element, a force is transmitted to the clamping member by a fixing element. The pivotable mounting serves as a pivot point of the clamping member so that, ensuing from the leverage effect, a greater force is transmitted to the second housing element in the contact area. The contact area may coincide, at least partially, with the second connection area. Preferably, the edge of the second housing element is rounded in the region of the contact area.

In this embodiment it is possible that the clamping member is pivoted during the assembly until it is adjacent, with the contact area, to the rounded edge of the second housing element. The force subsequently applied to the second connection area is transmitted more intensively to the second housing element in the contact area.

In another preferred embodiment the luminaire comprises a seal which is arranged between the first housing element and the second housing element and rests against the first housing element and the second housing element. In this case, the first housing element is clamped by the clamping member relative to the second housing element in the assembled state so that the second housing element is pressed against the seal, and the seal seals the first housing element against the second housing element. Using a seal in combination with the clamping member results in a particularly good sealing effect. In particular when using the clamping member as a lever the high clamping effect yields a particularly effecting sealing.

In this embodiment it is possible that the clamping member is pivoted during the assembly until it rests, with the contact area, against the rounded edge of the second housing element. The force subsequently applied to the second connection area is transmitted more intensively to the second housing element in the contact area so that the second housing element is pressed against the seal, and compresses the seal. Thus, the second housing element moves toward the seal, and the clamping member correspondingly pivots along. The clamping member and the rounded edge are configured to remain in contact during the connecting process.

In this embodiment it is conceivable that at least another component of the luminaire, e.g. a cover glass, is arranged between the first housing element and the second housing element and rests against the seal. Also, it is conceivable that at least one other component of the luminaire is arranged between the seal and the first housing element and/or between the seal and the second housing element so that the seal is only indirectly adjacent to at least one of the two housing elements.

BRIEF DESCRIPTION OF THE DRAWINGS

Advantageous exemplary embodiments of the present invention will be explained in more detail below by means of drawings. In the drawings.

DETAILED DESCRIPTION

In the following description like parts will be designated with like reference numbers. If a drawing includes reference numbers which are not referred to in the associated description of the figure, reference will be made to the preceding or subsequent description of the figure.

Figure 1:
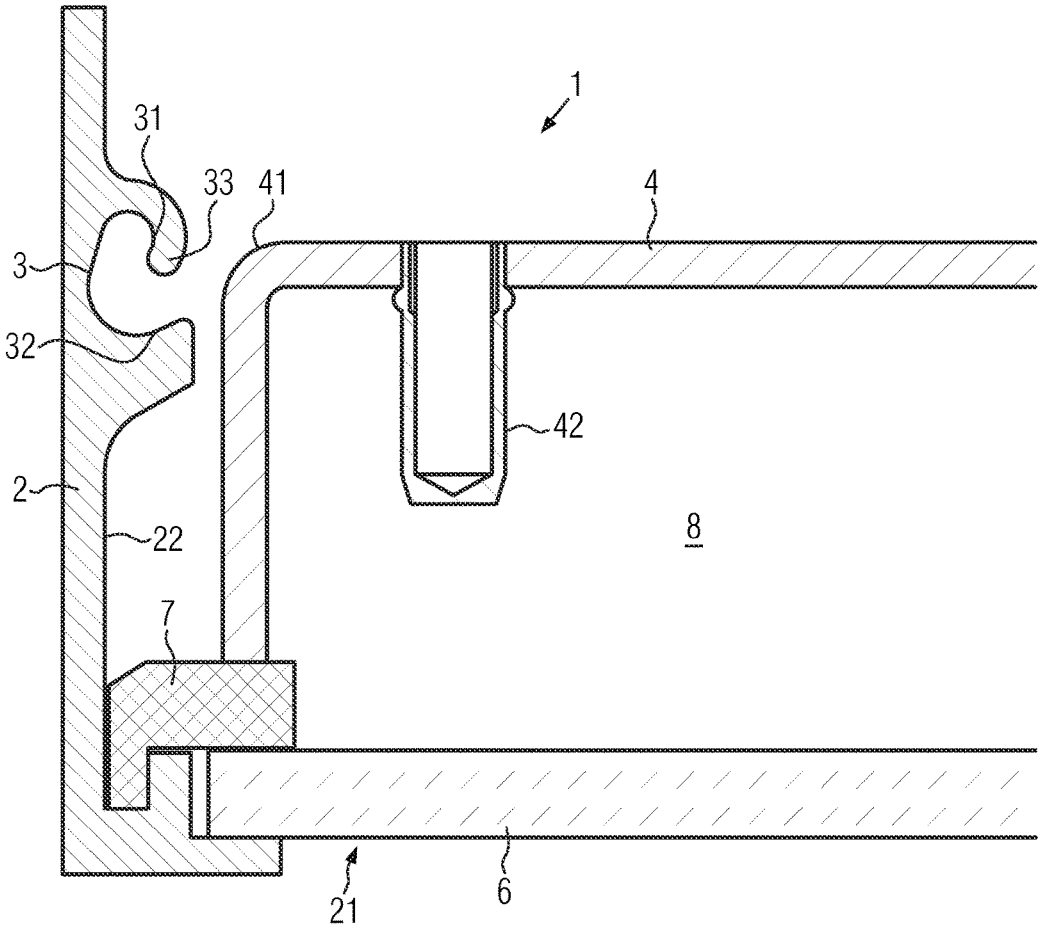
FIG. 1 shows a schematic cross-sectional view of a luminaire according to the invention without a clamping member.

The luminaire 1 according to the invention as illustrated in FIG. 1 comprises a first housing element 2 having a groove 3, a second housing element 4, and a non-illustrated clamping member 5. The first housing element 2 is configured as a one-part housing frame, defining a light outlet opening 21 on the bottom side thereof and having a circumferential groove 3 on the inside 22 thereof. A cover glass 6 is arranged on the housing frame 2, in the region of the light outlet opening 21. A seal 7 rests against the housing frame 2, the second housing element 4 and the cover glass 6.

The second housing element 4 is designed as a one-part lid and has rounded edges 41 and threaded bores 42 for receiving screws 9 on the upper side thereof. In the exemplary embodiment shown the cover glass 6 is configured as one part. The seal 7 integrally surrounds the total lower edge of the housing frame 2. A clearance 8 is provided between the lid 4 and the cover glass 6 in which additional, non-illustrated components of the luminaire 1 may be arranged, e.g. the light source or the power supply.

In the embodiment shown the groove 3 has a first undercut 31 upwardly and a second undercut 32 downwardly. The first undercut 31 has the shape of a circle segment and encompasses the circle-segment-shaped end 54 of the first connection area 51 so that the clamping member 5 is pivotably mounted. The second undercut 32 has a tub-shaped configuration and overlaps the first connection area 51, the first connection area 51 resting against the second undercut 32 in the assembled state.

Figure 2:
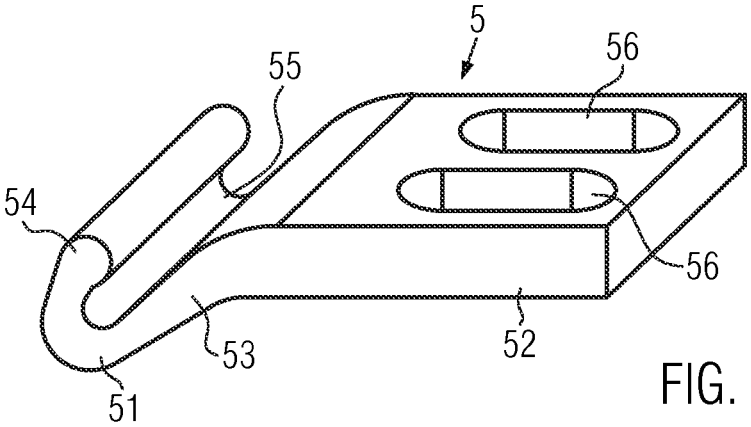
FIG. 2 shows a perspective schematic view of a clamping member of a luminaire according to the invention.

FIG. 2 shows an exemplary embodiment of a clamping member 5 of a luminaire according to the invention. The clamping member 5 has a first connection area 51, a second connection area 52 and a contact area 53. In the embodiment shown the clamping member 5 is produced from a metal section. The first connection area 51 is hook-shaped. The end of the first connection area 51 has the shape of a circle segment so as to interact with the first undercut 31 of the groove 3. The hook-shaped configuration creates a substantially U-shaped intermediate area 55 with which the wall 33 of the first undercut 31 engages, thus upwardly limiting the range of the angle of rotation. Moreover, the clamping member 5 is prevented from falling out of the groove 3 perpendicular to the surface of the inner housing wall 22. The tub-shaped second undercut 32 additionally prevents the clamping member 5 from falling out parallel to the inner housing wall 22 so that the clamping member 5 is captively held in the groove 3 in all pivoted positions. In the embodiment shown the second connection area 32 includes two slots 56.

Figure 3:
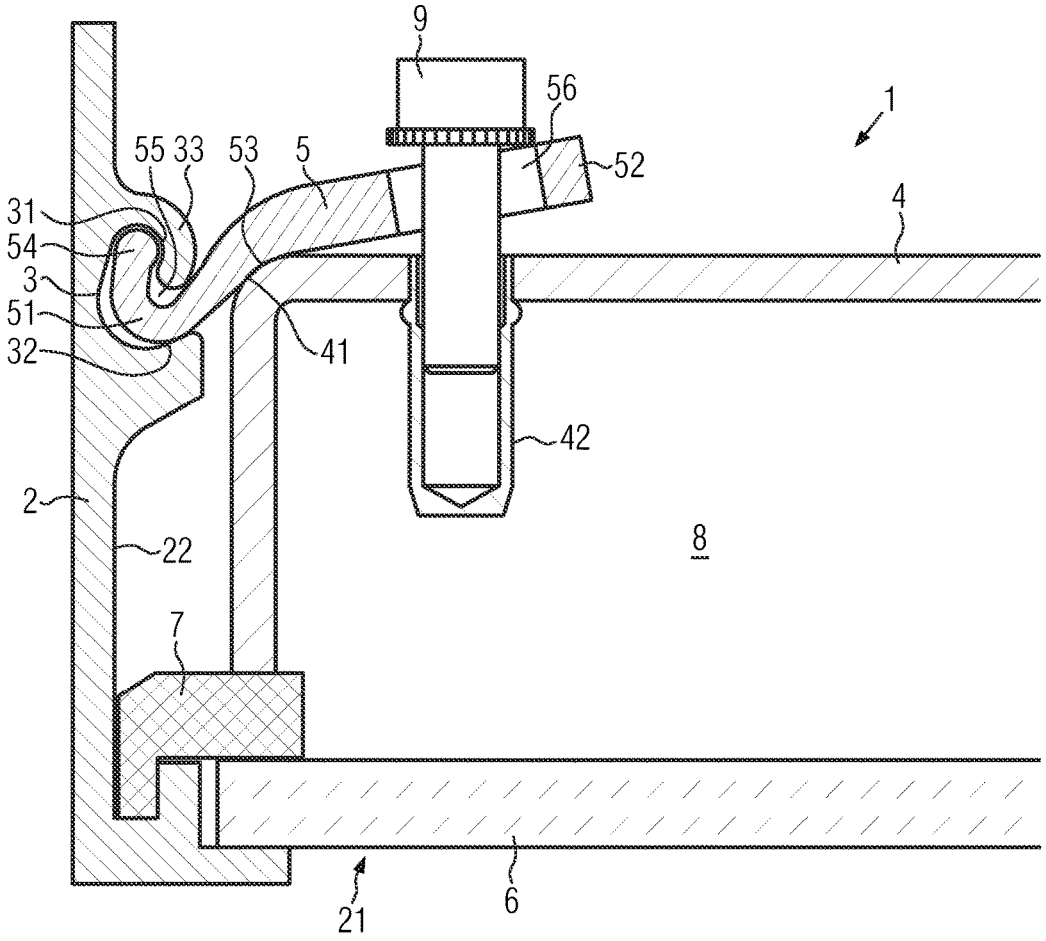
FIG. 3 shows a cross-section of a schematically illustrated first embodiment of a luminaire according to the invention.

FIG. 3 shows the clamping member 5 of FIG. 2, arranged in the groove 3 according to the embodiment of FIG. 1. A screw 9 penetrates the clamping member 5 at a slot 56, and is introduced into the threaded bore 42 on lid 4. The clamping member 5 rests with the contact area 53 against the rounded edge 41 of the lid 4. Thus, the clamping member 5 acts like a lever, whereby the force applied by the screw 9 to the clamping member 5 from above is more intensively transmitted downwardly to the lid 4 in the contact area 53.

Figure 4:
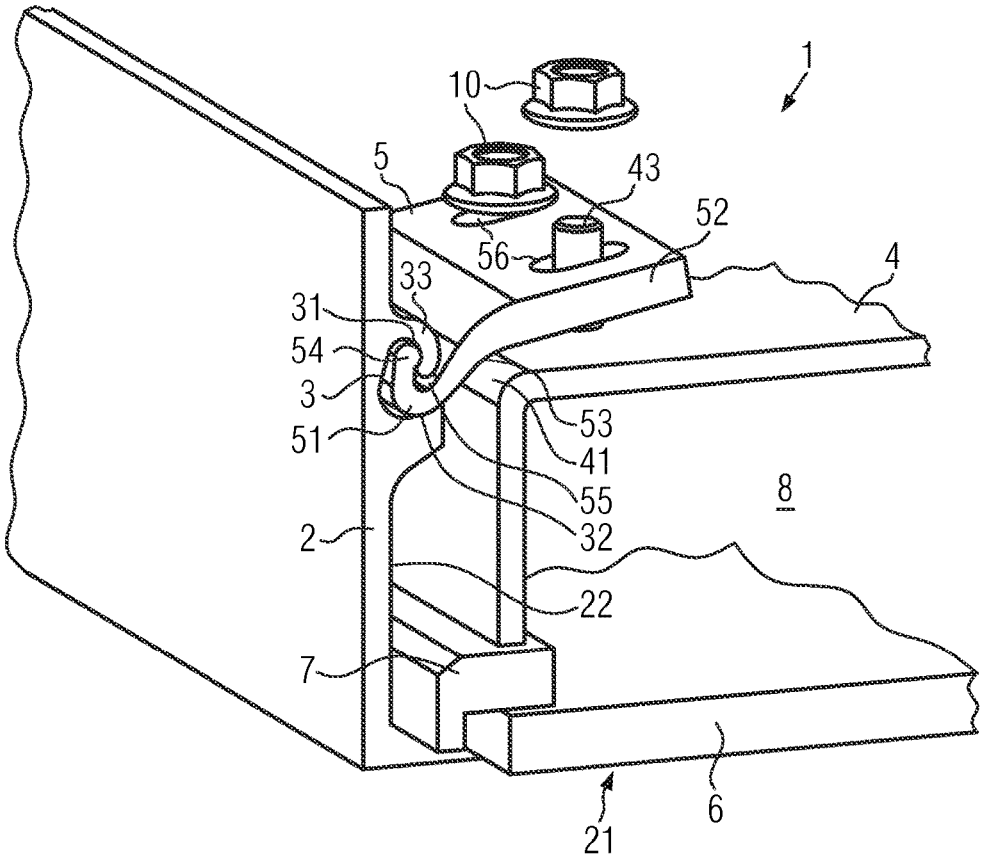
FIG. 4 shows a perspective schematic sectional view of a second embodiment of a luminaire according to the invention.

The embodiment illustrated in FIG. 4 corresponds to the embodiment of FIG. 3. However, threaded bolts 43 are formed on the lid 4, which penetrate the clamping member 5 and onto which nuts 10 are screwed for fastening them.

Figure 5:
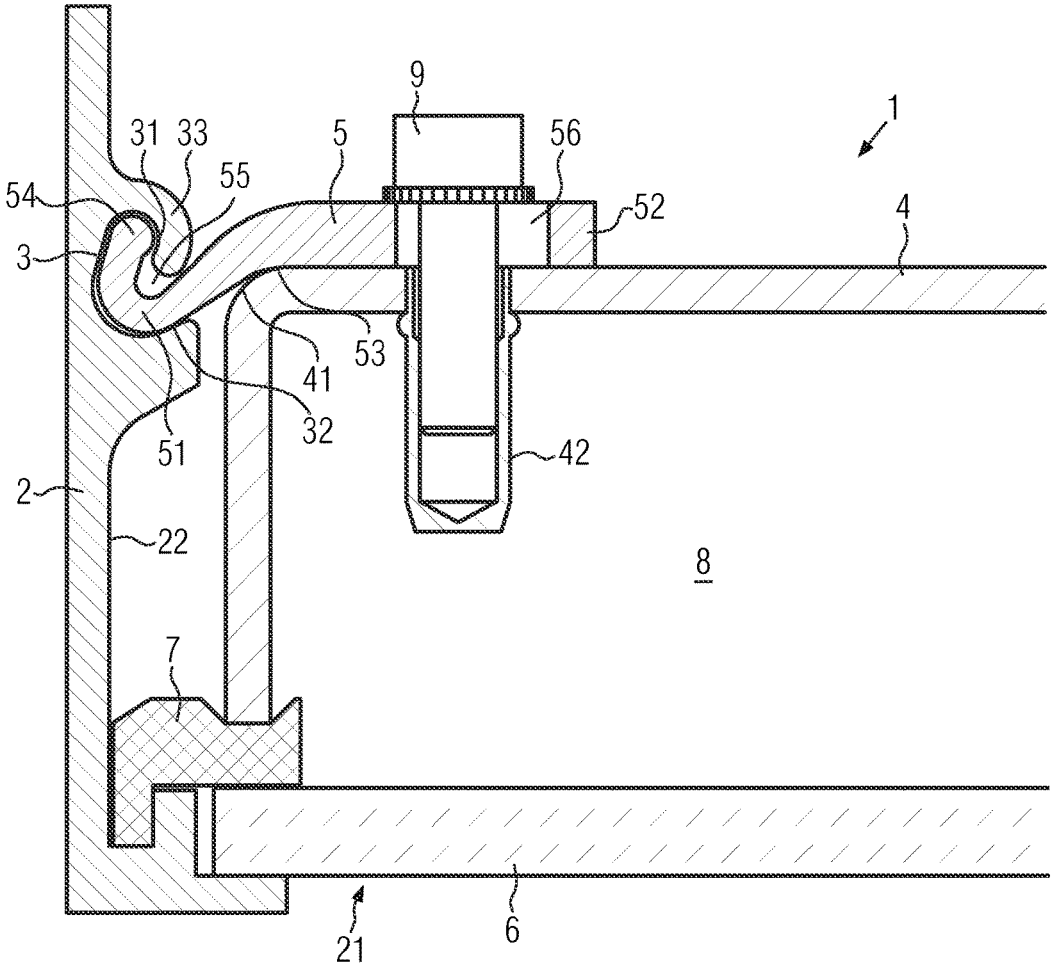
FIG. 5 shows a schematic cross-sectional view of the luminaire of FIG. 3 in the assembled state.

FIG. 5 shows the embodiment of FIG. 3 in the assembled state. During the transfer into the assembled state the screw 9 has moved in the slot 56. Due to the rounded edge 41 and the rounded contact area 53 the second housing element 4 and the clamping member 5 are in contact with one another during the clamping process across a large contact surface. The first connection area 51 is in contact with the second undercut 32 so that the clamping member 5 cannot be pivoted further. This limitation prevents damage to the individual components. The lid 4 is pressed against the seal 7, so that the lid 4 is sealed against the housing frame 2.

Figure 6:
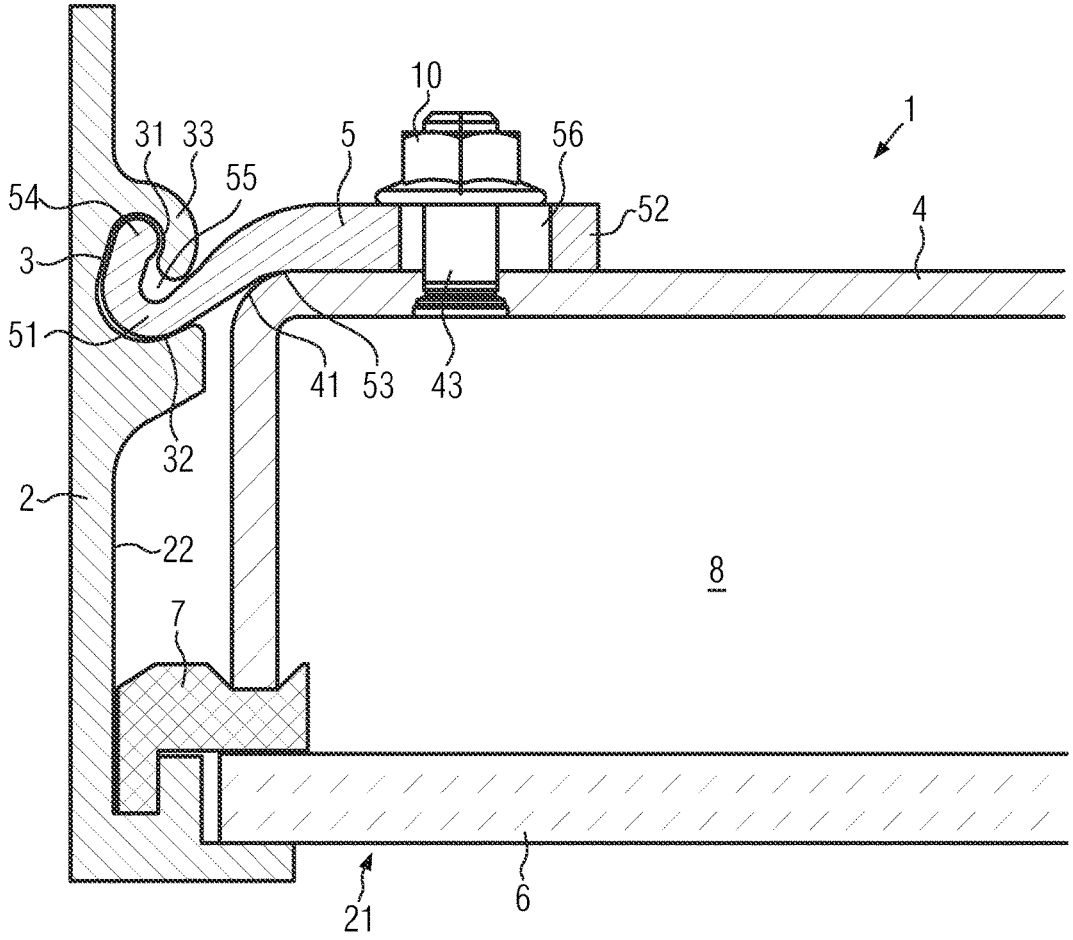
FIG. 6 shows a schematic cross-sectional view of the luminaire of FIG. 4 in the assembled state.

FIG. 6 shows the embodiment of FIG. 4 in the assembled state.

Figure 7:
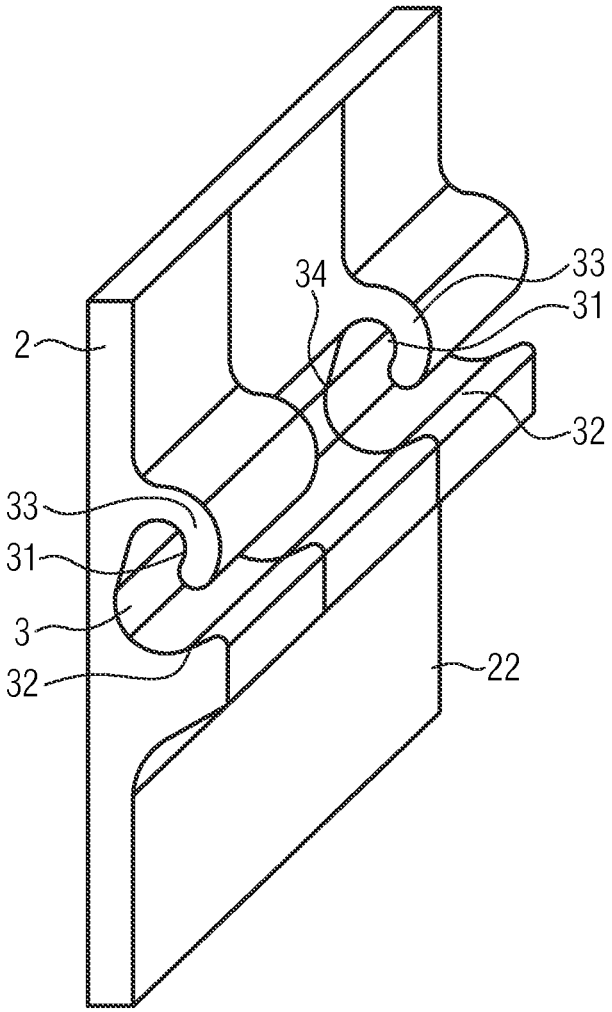
FIG. 7 shows a perspective schematic view of the groove of the luminaire according to the invention.

FIG. 7 illustrates the insertion portion 34 of the groove 3 of a luminaire 1 according to the invention. In the embodiment shown the first undercut 31 of the groove 3 is discontinued in the insertion portion 34. The groove 3 is further configured such that the clamping member 5 of FIG. 2 can be displaced in groove 3 along the longitudinal extension of groove 3. For inserting the clamping member 5 the clamping member 5 is initially introduced from above into the insertion portion 34 and then pushed in, along the longitudinal extension of the groove 3, from the insertion portion 34 into the groove 3.

Figure 8:
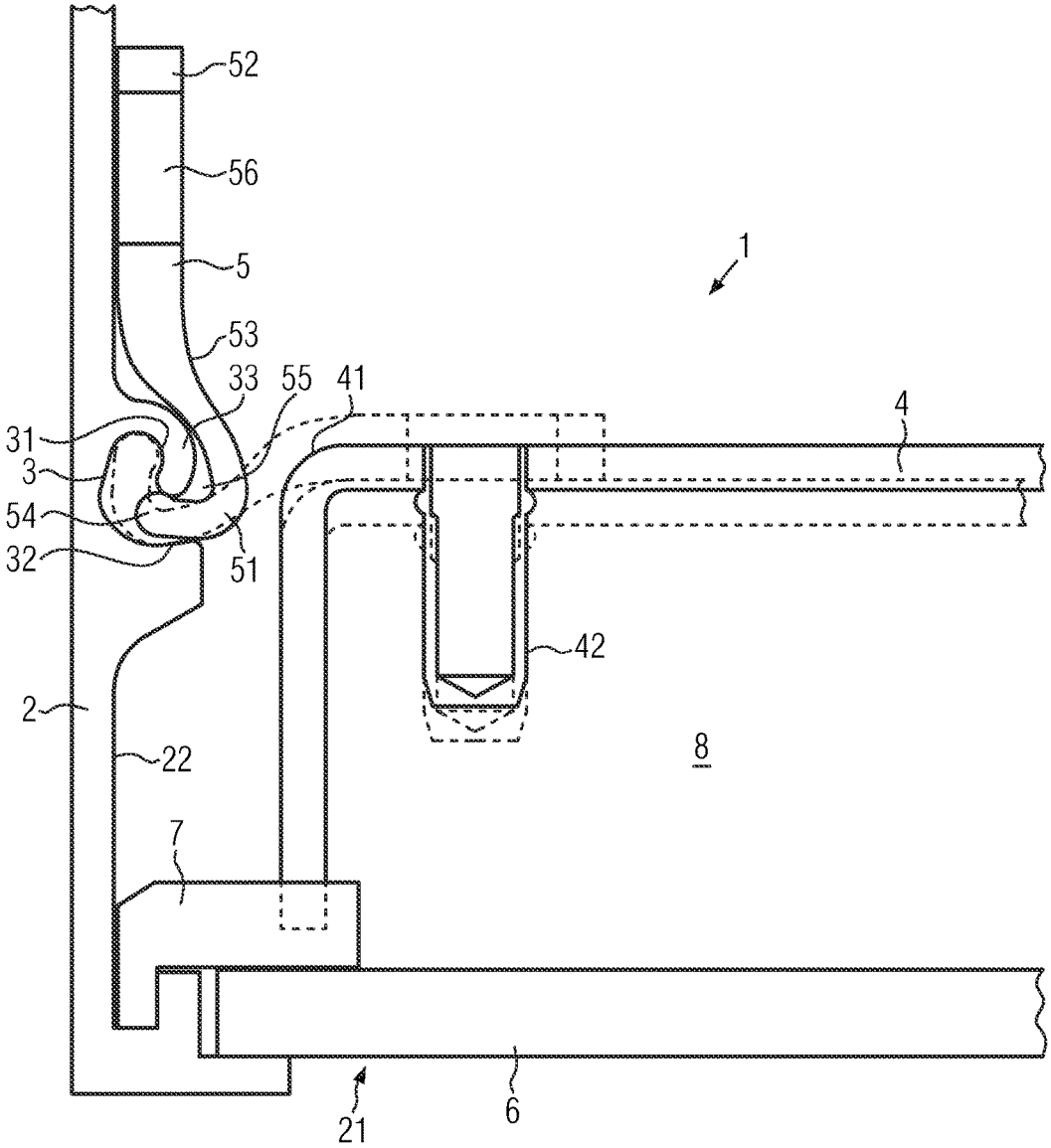
FIG. 8 shows a cross-section of a schematically illustrated third embodiment of a luminaire according to the invention.
Figure 9:
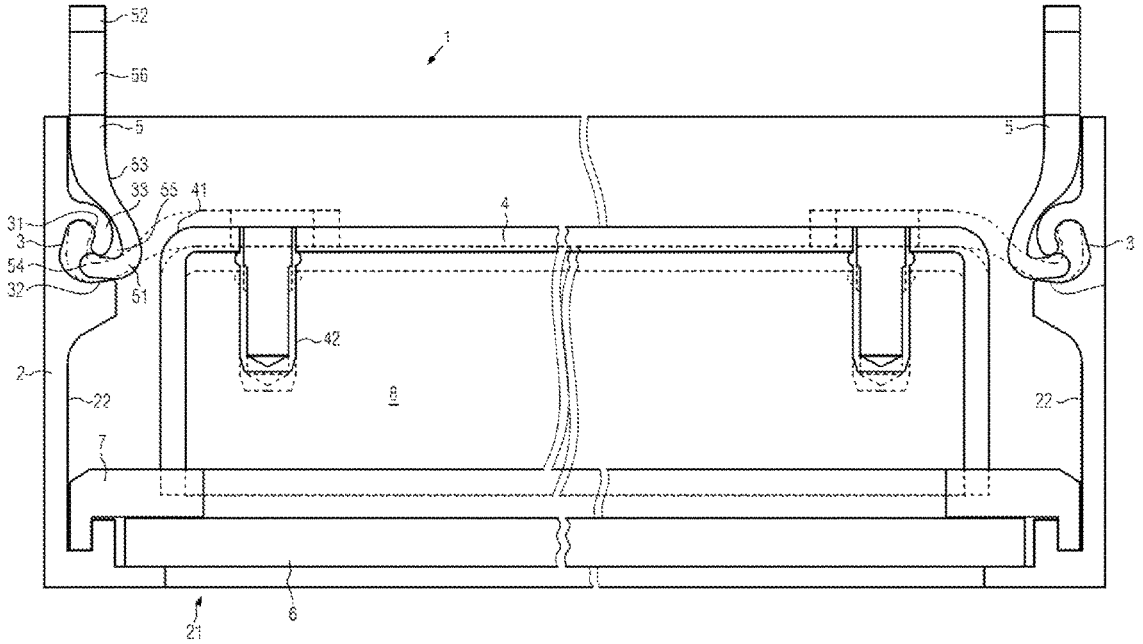
FIG. 9 shows an expanded cross-sectional side view of FIG. 8 from end to end.

FIG. 8 shows another embodiment of a luminaire 1 according to the invention, which differs from the embodiment illustrated in FIG. 1 by the configuration of the groove 3 and the clamping member 5. The clamping member 5 is in the assembling position. In the embodiment shown the angle of rotation between the assembled position, which is shown in dashed lines, and the assembling position is approximately 90°. When transferring the clamping member 5 into the assembling position the end 54 of the first connection area 51 has pivoted in the first undercut 31 and performed a translation. On the opposite inner side 22 of the housing frame 2, too, a clamping member 5 is provided in groove 3 in the assembling position. The clear distance of the two clamping members 5 is greater than the expansion of the lid 4. Thus, the lid 4 can be inserted into the housing frame 2 from above in a straight line after the clamping members 5 were arranged in groove 3 in the assembling position. It is also conceivable, however, to insert the clamping member 5 later.

The invention claimed is:

1. A luminaire with a luminaire housing, comprising:

a housing frame as a first housing element of the luminaire housing, the first housing element including at least one groove, a housing lid as a second housing element of the luminaire housing, and a clamping member, the clamping member comprising a first connection area and a second connection area, the first connection area interacting with the groove and the second connection area being screwed, in the assembled state, to the second housing element so that the second housing element is clamped by the clamping member relative to the first housing element, wherein the clamping member is pivotably mounted in the groove, in a plane perpendicular to the longitudinal extension of the groove.

2. The luminaire according to claim 1, wherein the clamping member is captively held in the groove in at least one pivoted position.

3. The luminaire according to claim 1, wherein the clamping member, pivoting in the groove, can be transferred from an assembling position into the position in the assembled state.

4. The luminaire according to claim 3, wherein the angle of rotation between the position in the assembled state and the assembling position is at least 60°.

5. The luminaire according to claim 3, wherein the first housing element surrounds the second housing element in a frame-like manner and at least two opposite inner sides of the first housing element comprise a groove each interacting with at least one clamping member, the perpendicular clear distance of two opposite clamping members being, in the assembling position, at least as large as the expansion of the second housing element.

6. The luminaire according to claim 1, wherein the clamping member can be displaced in the groove along the longitudinal extension of the groove.

7. The luminaire according to claim 1, wherein the groove is discontinued by at least one insertion portion, the clamping member being insertable into the groove, through the insertion portion, in the direction of the longitudinal extension of the groove.

8. The luminaire according to claim 1, wherein the groove and the clamping member interact in the manner of a hinge joint.

9. The luminaire according to claim 1, wherein the groove comprises a first undercut which encompasses the end of the first connection area.

10. The luminaire according to claim 9, wherein the groove comprises a second undercut, the second undercut overlapping the first connection area.

11. The luminaire according to claim 1, wherein the first connection area is formed substantially hook-shaped.

12. The luminaire according to claim 1, wherein at least one slot is formed in the second connection area which, in the assembled state of the clamping member, extends perpendicular to the longitudinal extension of the groove.

13. The luminaire according to claim 1, wherein the edges of the second housing element are rounded, at least in the region of the clamping members.

14. The luminaire according to claim 1, wherein the clamping member comprises a contact area which is arranged between the first connection area and the second connection area, the contact area being in contact with an edge of the second housing element at least in the assembled state so that the clamping member is configured as a one-sided lever, with the first connection area being the pivot point and the contact area and the second connection area being the points of contact.

15. The luminaire according to claim 1, wherein the luminaire further comprises a seal which is arranged between the first housing element and the second housing element and rests against the first housing element and the second housing element, the first housing element being clamped by the clamping member relative to the second housing element in the assembled state so that the second housing element is pressed against the seal, and the seal seals the first housing element against the second housing element.

* * * * *